US006269996B1

(12) United States Patent
McAllister

(10) Patent No.: US 6,269,996 B1
(45) Date of Patent: Aug. 7, 2001

(54) FASTENER DRIVING APPARATUS AND METHOD

(75) Inventor: Richard Lynn McAllister, Colgate, WI (US)

(73) Assignee: Robbins, Inc., Cincinnati, OH (US)

( * ) Notice: Subject to any disclaimer, the term of this patent is extended or adjusted under 35 U.S.C. 154(b) by 0 days.

(21) Appl. No.: 09/370,351

(22) Filed: Aug. 6, 1999

(51) Int. Cl.[7] ..... B27F 7/02

(52) U.S. Cl. ..... 227/7; 227/8; 227/111; 227/148

(58) Field of Search ..... 227/7, 110, 111, 227/2, 5, 6, 8, 148; 324/67

(56) References Cited

U.S. PATENT DOCUMENTS

| | | | | |
|---|---|---|---|---|
| 2,915,754 | * | 12/1959 | Wandel | 227/7 |
| 3,173,593 | | 3/1965 | Elliott . | |
| 3,619,895 | * | 11/1971 | Thompson | 227/7 |
| 3,764,053 | * | 10/1973 | Thompson | 227/111 |
| 3,796,365 | | 3/1974 | Downing . | |
| 3,820,704 | * | 6/1974 | Stanley | 227/110 |
| 3,984,040 | * | 10/1976 | Fry | 227/7 |
| 4,084,738 | | 4/1978 | Schneider . | |
| 4,225,074 | * | 9/1980 | Jacobson | 227/111 |
| 4,265,387 | * | 5/1981 | Strouse | 227/7 |
| 4,350,279 | * | 9/1982 | Haley | 227/110 |
| 4,523,706 | | 6/1985 | Haley . | |
| 4,732,307 | | 3/1988 | Hubbard et al. . | |
| 5,062,562 | | 11/1991 | Michael . | |
| 5,110,027 | | 5/1992 | Burlingame . | |
| 5,125,552 | * | 6/1992 | Medwed | 227/110 |
| 5,197,257 | * | 3/1993 | Nietling | 227/111 |
| 5,406,441 | | 4/1995 | Warda et al. . | |
| 5,500,783 | * | 3/1996 | Warda et al. | 227/7 |
| 5,562,240 | * | 10/1996 | Campbell | 227/5 |
| 5,749,508 | | 5/1998 | Clothier . | |
| 6,064,189 | * | 5/2000 | Frankel | 324/67 |

FOREIGN PATENT DOCUMENTS

| | | |
|---|---|---|
| 9406952 | 9/1994 | (DE) . |
| 2173976 | 6/1995 | (FR) . |

* cited by examiner

*Primary Examiner*—Scott A. Smith
(74) *Attorney, Agent, or Firm*—Wood, Herron & Evans L.L.P.

(57) ABSTRACT

A fastener driving apparatus having a carriage supporting a fastener driver and adapted for translation across a flooring member being fastened by fasteners from the fastener driver. The fastener driver is preferably supported in a carriage at an angle with respect to a fully vertical position for driving fasteners at an angle with respect to the flooring member and more preferably into the side of the flooring member and into the underlying structure. More preferably, the angle of the fastener driver is adjustable. Carriage motion elements permit translation of the fastener driving apparatus across the flooring and are preferably arranged so that they exert a lateral force upon the apparatus when the apparatus is pushed. This lateral force preferably causes one or more carriage guide elements running alongside the flooring member to remain in contact with the flooring member, thereby maintaining a constant positional relationship between the fastener driving apparatus and the flooring member for accurate fastener placement. A pneumatic, hydraulic, electrical, or other such circuit is employed to transmit signals from at least one trigger to a valve, an actuator, or the fastener driver, in each case resulting in actuation of the fastener driver to drive a fastener into the flooring member at a desired time. The trigger can be a manually-operated trigger, a cam-operated trigger on a carriage motion element for periodically triggering the fastener driver, a follower trigger for physically sensing structure underlying the flooring member, and/or a sensor trigger for detecting density underlying the flooring member.

21 Claims, 7 Drawing Sheets

FASTENER DRIVING APPARATUS AND METHOD

FIELD OF THE INVENTION

This invention relates generally to systems and methods for driving fasteners, and more particularly to systems and methods for driving fasteners through an element or member to secure the element or member beside a previously-laid surface.

BACKGROUND OF THE INVENTION

The process of laying flooring is generally very time consuming and labor intensive. Depending upon the type of flooring being installed, the cost of flooring can vary significantly. Hardwood flooring is among the more expensive flooring types not only due to the cost of materials but also because hardwood flooring is typically difficult to install, requiring skilled labor and particular installation procedures for a satisfactory floor. An example of such flooring is hardwood gym flooring. The process of laying gym flooring is particularly difficult in that each individual board making up the floor must be precisely placed with respect to previously-laid flooring, forced into place with a mallet or other device, and then secured via one or more fasteners. With gym flooring and many other hardwood and non-hardwood flooring types, fasteners which are visible after flooring installation are unacceptable. Therefore, it is common practice (especially in the installation of hardwood and gym floors) to drive fasteners diagonally through a side edge of the flooring pieces or boards, which fasteners are thereafter covered from view when adjacent flooring pieces or boards are laid. Unfortunately however, the process of driving fasteners diagonally through each flooring piece or board is very labor intensive and is conventionally performed by hand or by a hand-held fastener driving device such as a nail gun or staple gun. This results in high labor costs and is a primary factor dictating the length of time necessary to install such flooring.

Many devices exist which increase the speed with which fasteners may be driven into a surface. Three such devices are disclosed in U.S. Pat. No. 4,084,738 issued to Schneider, U.S. Pat. No. 3,173,593 issued to Elliott, and U.S. Pat. No. 5,110,027 issued to Burlingame. Conventional fastener driving devices such as those disclosed in the Schneider, Elliott and Burlingame patents have a carriage or other structure which can be moved over a surface to drive fasteners into the surface. However, such devices are designed for use in driving nails or other fasteners in a vertical direction, and are therefore well-suited for roofing applications and for flooring applications in which the visibility of the fasteners is not a concern and/or vertically-driven fasteners are acceptable. However, these devices are not capable of driving fasteners at an angle with respect to the pieces or boards of flooring being laid, nor are they capable of driving fasteners in such a way as to hide them from view after surrounding flooring pieces or boards have been laid. Therefore, conventional fastener driving carriage devices are poorly suited for many flooring applications, including without limitation most hardwood flooring applications.

The difficulty in securing flooring pieces or boards is exacerbated by the precision required when driving fasteners into such elements. The process of driving a fastener into a side of a flooring piece or board requires much greater precision than simply driving a fastener vertically down through an upper surface of the piece or board. Conventional nail driving devices do not provide any structure or features for controlling firing angle and position and so therefore are not suitable for driving fasteners in this manner. Also, in many flooring systems flooring boards or pieces do not rest upon a continuous structure into which fasteners can be driven. Instead, the flooring boards or pieces are often laid and fastened atop a frame or other structure (a series of spaced sleepers or other framework). Fasteners driven into the flooring boards or pieces must therefore be aligned with portions of the frame or structure. Fastener alignment can be very difficult to accomplish, particularly because the frame or structure is usually partially blocked from view by the pieces or boards of flooring being laid. In some cases, the frame or structure is fully blocked from view by subflooring such as plywood paneling. Fastener alignment can be made even more difficult when a conventional fastener driving apparatus or carriage is employed such as disclosed in the Schneider, Elliott and Burlingame patents. Even where the portions of the subflooring are regularly spaced and where such apparatuses or carriages are operated to drive fasteners at regularly spaced intervals, measurement inaccuracies and inconsistencies in the underlying frame or structure still interfere with proper fastener alignment and placement.

In light of the problems and limitations of the prior art described above, a need exists for a fastener driving apparatus and method which can be used to quickly drive fasteners into flooring at a desired angle, which drives fasteners in a manner so that they are hidden from view after surrounding flooring has been laid, which preferably can be used to quickly and precisely drive fasteners in the sides of flooring pieces or boards, and which can accurately drive fasteners through flooring pieces or boards and into underlying framework or other such structure even if blocked from view. Each preferred embodiment of the present invention achieves one or more of these results.

SUMMARY OF THE INVENTION

The present invention utilizes a fastener driver mounted to a carriage movable across a flooring surface and responsive to one or more trigger devices for driving fasteners into a board or piece of flooring to secure the same to underlying structure. To permit fasteners to be driven at angles (particularly for driving fasteners into the sides of boards or pieces of flooring materials to hide the fasteners from view in the completed flooring), the fastener driver of one preferred embodiment is preferably mounted at an angle with respect to a fully vertical position and even more preferably is adjustable to change the angle at which the fastener driver drives the fasteners.

The carriage has at least one set of carriage motion elements which enable the carriage to move across the flooring. Preferably, the carriage motion elements include at least one carriage wheel positionable to roll across the flooring surface beside the board or piece of flooring being fastened. The carriage also preferably includes other carriage motion elements supporting a baseplate of the carriage to which the fastener driver is attached for movement over the flooring surface. To guide the fastener driving apparatus as it is moved along the board or piece of flooring being fastened, one or more carriage guide elements are preferably attached to the carriage or extend therefrom and are positioned to contact and run alongside the board or piece of flooring being fastened. More preferably, the carriage guide element is a roller attached to the baseplate and rolling alongside and against the board or piece of flooring. Each roller employed thereby positions the fastener driver a desired substantially constant distance with respect to the side edge of the board or piece of flooring for consistent positioning and driving of fasteners into the board or piece of flooring. Most preferably, the carriage motion elements (e.g., the carriage wheels) are canted with respect to the path of motion of the apparatus to exert a lateral force against the carriage and to thereby maintain contact of the carriage guide element(s) with the side edge of the board or piece of flooring being fastened.

The fastener driving apparatus of the present invention also preferably has a handle assembly for enabling a user to conveniently push the apparatus along the board or piece of flooring being fastened. Preferably, the handle assembly is removable for easy transport or storage of the apparatus.

A circuit in the apparatus is employed to control fastener driving operations. The circuit can be pneumatic, hydraulic, electrical, or otherwise for transmitting signals from one or more trigger devices on the apparatus to directly or indirectly trigger the fastener driver. Most highly preferred embodiment circuits of the present invention have a manually-operable trigger for transmitting a trigger signal to drive a fastener at a user-controlled time, a cam follower trigger riding upon a cam surface of a carriage wheel for periodically sending a trigger signal based upon the rotational position of the carriage wheel, a board follower trigger for physically contacting and riding over sleepers, boards, framework, or other structure underlying the board or piece of flooring being fastened and thereupon sending a trigger signal, and a sensor trigger capable of detecting hidden sleepers, boards, framework, or other underlying structure (e.g., via density detection) and thereupon sending a trigger signal. Most highly preferred embodiments of the present invention also have a safety lever or other user-operable device for selectively enabling and disabling the above-described triggers.

Preferably, pneumatic, hydraulic, electrical or other signals transmitted by the above-noted triggers are received by a valve which then sends a signal to an actuator for driving the fastener driver. A fastener is thereby driven by the fastener driver into the new board or piece of flooring being fastened. However, in alternate embodiments of the present invention, the trigger signals can be received directly by the actuator or even directly by the fastener driver itself depending upon the type of actuator and/or fastener driver employed.

Still other advantages and features of the invention, together with the organization and manner of operation thereof, will become apparent from the following detailed description when taken in conjunction with the accompanying drawings wherein like elements have like numerals throughout the drawings.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
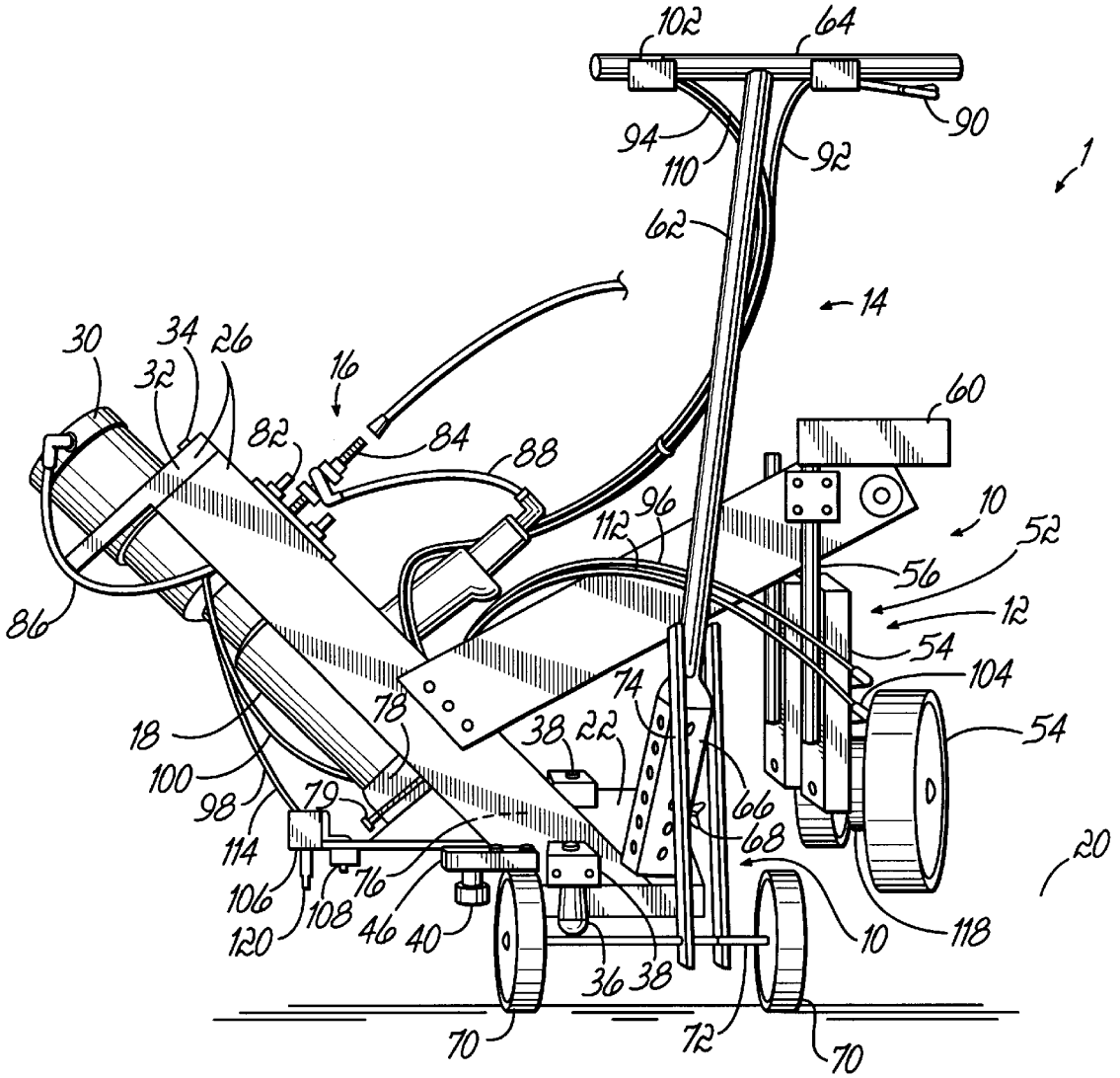
FIG. 1 is a perspective view of a fastener driving apparatus according to one preferred embodiment of the present invention.

For purposes of discussion, highly preferred embodiments of the fastener driving apparatus of the present invention (indicated generally at 1) include a carriage assembly 10, a carriage support assembly 12, a handle assembly 14 and a driver assembly 16. The driver assembly 16 has a driver 18 which is mounted upon the carriage assembly 10. The carriage assembly 10 can be pushed by the handle assembly 14, also mounted to the carriage assembly 10. The carriage support assembly 12 is secured to the carriage assembly 10 to permit the carriage assembly 10 to move over the floor surface 20 and to preferably bias the carriage assembly 10 for movement in a particular direction as will be described in more detail below.

The carriage assembly 10 of the present invention preferably performs a number of different functions: supporting the driver 18 at a desired angle and elevation with respect to the floor surface 20, providing a structure to which elements such as rollers, casters, wheels, or (less preferably) glide strips or other elements can be attached to permit smooth and properly directed movement of the carriage assembly 10 over the floor surface 20, providing a framework for the preferred pneumatic system of the driver assembly 16, and providing a structure to which the handle assembly 14 can be conveniently attached.

Preferably, the carriage assembly 10 has a baseplate 22 to which is attached a driver frame 26. A primary purpose of the driver frame 26 is to position an actuator 30 (described below) relative to the driver 18 so that actuation of the actuator 30 operates the trigger on the driver 18 to fire the driver 18. The driver frame 26 therefore can take a number of different forms capable of holding the actuator 30 in a position beside the trigger of the driver 18. In the preferred embodiment of the present invention shown in the figures, the driver frame 26 is a pair of side plates 28 extending from the baseplate 22 to positions flanking the sides of the driver 18. A top plate 32 of the driver frame 26 is preferably secured to the tops of the side plates 28, and has an aperture therethrough (not shown) for receiving the actuator 30.

The side plates 28 are preferably welded to the baseplate 22, and the top plate 32 is preferably attached to the side plates 28 by conventional threaded fasteners 34 passed through holes in the top plate 32 and into matching threaded holes in the side plates 28. It will be appreciated by one having ordinary skill in the art that these manners of connection are only two of many which can be employed with the same or similar results, other connection manners including without limitation riveting, bonding, press-fitting, gluing, nailing, brazing, or even making parts integral to one another by bending, extruding, stamping, or otherwise shaping material elements. The particular connection manner desired will be determined at least in part, however, by the type of framework employed, the material of the elements making up the framework, and any particular needs to disassemble the apparatus to remove the driver 18 and/or to service or transport the apparatus 1. The actuator 30 is also preferably mounted to the top plate 32 in any conventional manner such as those just described. However, in the preferred embodiment of the present invention the actuator 30 is attached to the top plate 32 by a number of threaded fasteners located around the actuator 30 and passed through holes in the actuator 30 and into matching threaded holes in the top plate 32.

The most highly preferred embodiments of the present invention perform best when the fastener driving apparatus 1 can be moved smoothly over a surface while fasteners are being driven into the floor surface 20. To accomplish this function, one preferred embodiment of the present invention has carriage motion elements fastened to the baseplate 22 and capable of translating the baseplate 22 across the floor surface 20. Most preferably, the carriage motion elements are casters 36 attached to the baseplate 22 in any well known fashion such as by any of the connection manners discussed above with respect to the driver frame 26. The casters 36 roll to steadily carry and translate the carriage assembly 10 over the floor surface 20. More preferably, a caster 36 is mounted to each of the front and rear ends of the base plate 22 by threaded fasteners passing through caster mounts 38 and into matching threaded holes in the baseplate 22. The casters 36 are preferably vertically adjustable in a conventional fashion to enable a user to adjust the height at which the carriage assembly 10 is supported over the floor surface 20. Although casters 36 are preferred due to their combined ability to pivot and roll, other well known devices and elements can instead be used for the carriage motion elements to support the carriage assembly 10 above the floor surface while permitting driving apparatus translation. These alternate devices and elements include without limitation wheels, belt treads, wear strips or members (low friction or otherwise), and the like, and are preferably vertically adjustable in a conventional fashion, such as by screw adjustment mechanisms, setscrew and post adjustment assemblies, adjustable clamping mechanisms, loosenable bolts in slotted members, etc.

Although the present invention can be used for driving fasteners into flooring which is not at the edge of previously-laid flooring (i.e., is a piece, board, or other member of flooring surrounded by other pieces, boards, or other members of flooring), most highly preferred embodiments of the present invention can be operated to drive fasteners at an angle into an exposed side of a board or piece of flooring. In this manner, the heads or tops of the fasteners securing the board or piece of flooring to underlying elements, framework, bodies, or other structure will be hidden between the edges of adjacent boards or pieces of flooring.

Figure 2:
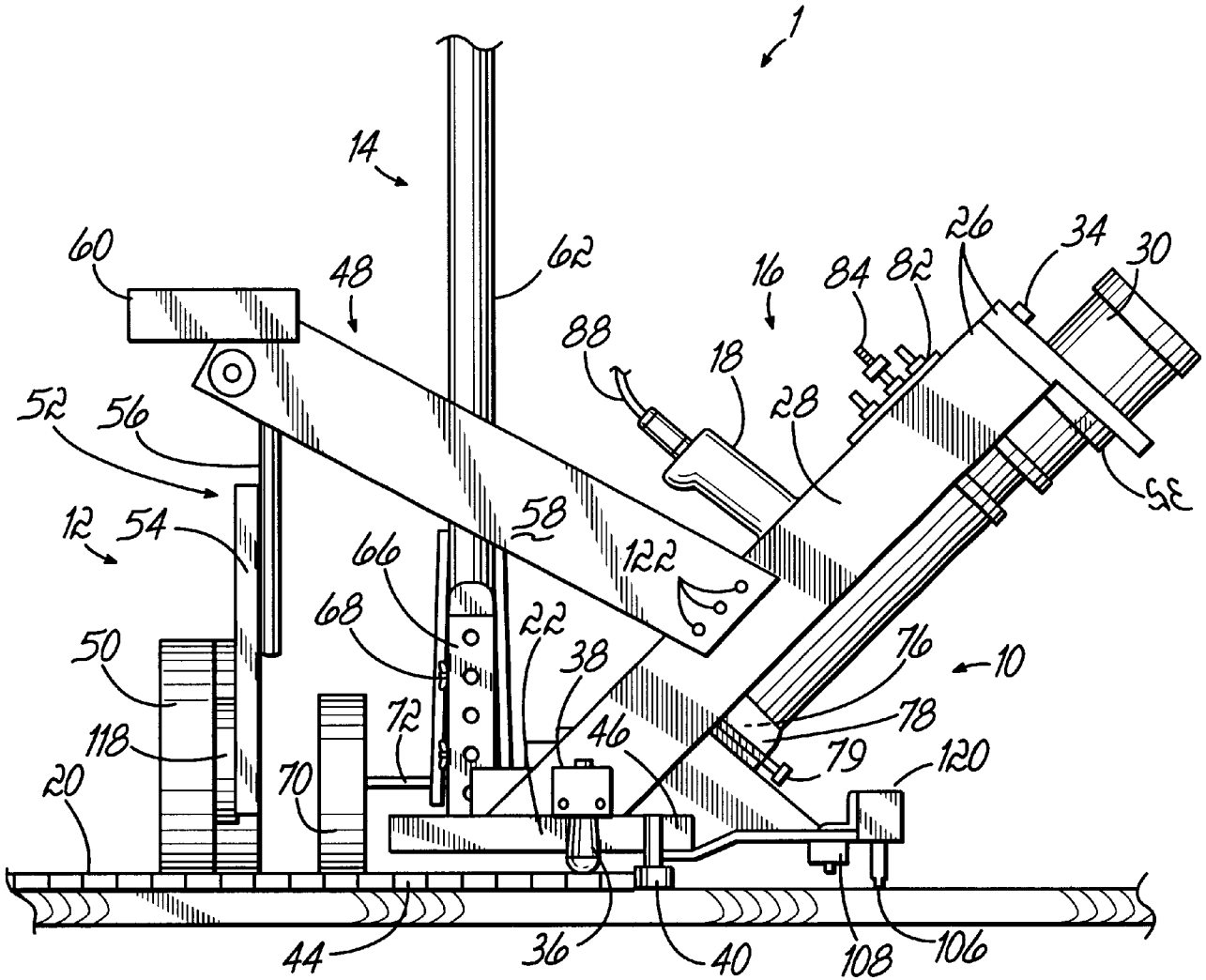
FIG. 2 is an elevational front view of the fastener driving apparatus illustrated in FIG. 1, shown riding upon a board being fastened to an underlying sleeper framework.
Figure 5:
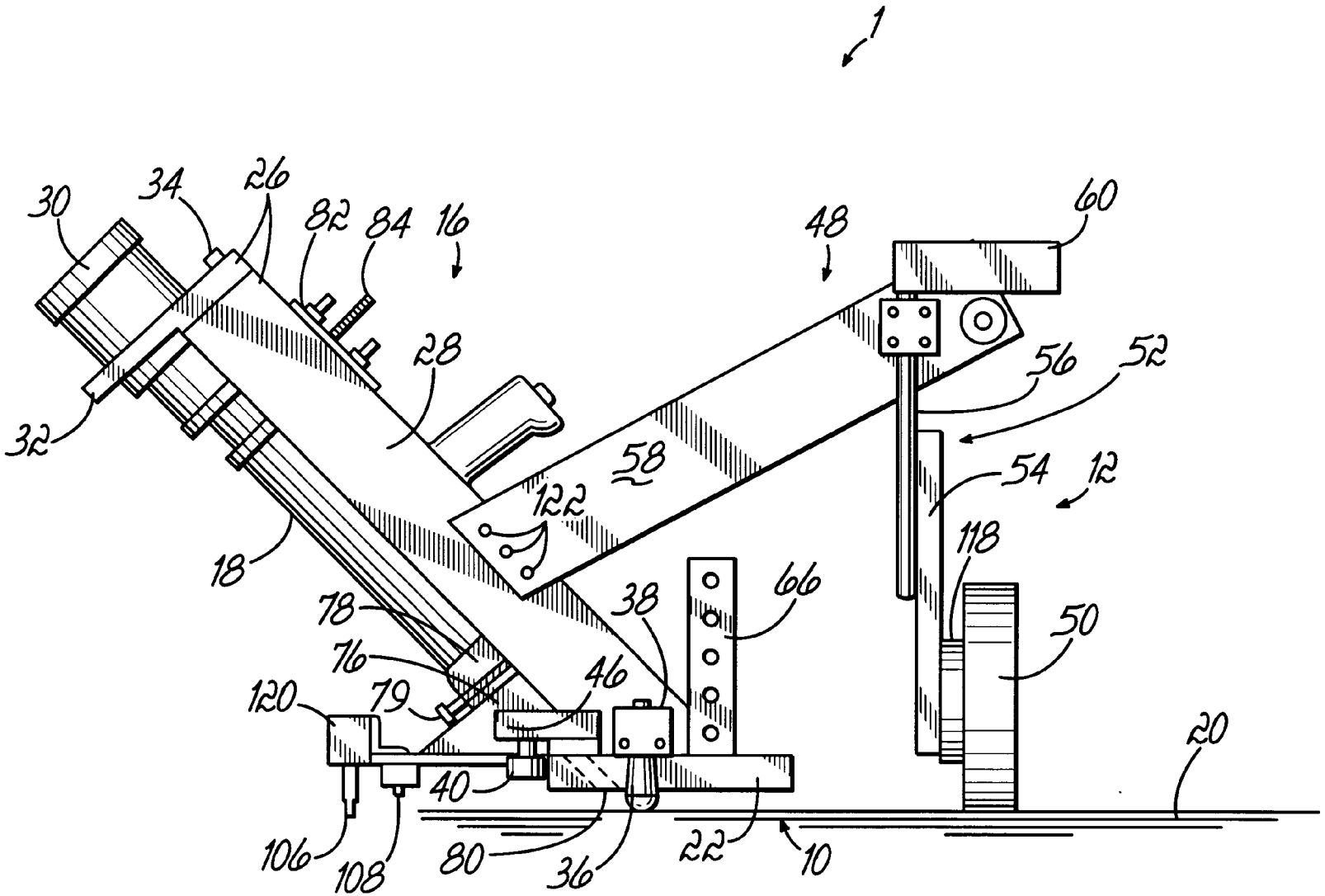
FIG. 5 is an elevational rear view of the fastener driving apparatus illustrated in FIGS. 1–4, showing the handle assembly removed.

To ensure that the fastener driving apparatus 1 is properly positioned for such fastener driving operations, preferred embodiments of the present invention have one or more devices or elements which guide the carriage assembly 10 as it is moved along the new board or piece of flooring 42 being secured in place beside the previously-laid flooring 44 as best shown in FIGS. 2 and 5. Specifically, the carriage assembly 10 preferably has at least one guide roller 40 (and more preferably two) which rolls alongside the new board or piece of flooring 42 (i.e., a "member" or "structure") as it is being fastened beside the previously-laid flooring 44. Like the casters 36, the guide rollers 40 are preferably vertically adjustable in any conventional manner such as those mentioned above with respect to the vertically adjustable casters 36.

The guide rollers 40 also preferably have a limited horizontal adjustment for adjusting the horizontal lateral distance between the driver 18 and the edge of the new board or piece of flooring 42. Such adjustment can be made in any conventional manner, including by releasable threaded fasteners passed through slotted holes in guide roller mounts 46 shown in the figures, an adjustable clamping mechanism such as the relationship between the carriage support assembly frame 48 and the carriage wheel posts 52 discussed below, a threaded rod extending horizontally from the guide roller axle and threaded into the baseplate 22, and the like. It will be appreciated by one having ordinary skill in the art that many other elements and assemblies can be used to perform the same function as riding against the side of a new board or piece of flooring 42 while the fastener driving apparatus 1 is pushed therealong in order to guide the fastener driving apparatus 1. Other such carriage guide elements include without limitation wear surfaces or strips (low friction or otherwise) extending below the lower surface of the baseplate 22 and riding against the edge of the new board or piece of flooring 42, one or more lips, ribs, posts, or fingers on the edge of the baseplate 22 and extending over the edge of the new board or piece of flooring 42, and the like.

The carriage support assembly 12 of preferred embodiments of the present invention helps to further support the carriage assembly 10 for translational movement over the floor surface 20 and assists in such movement via one or more carriage motion elements (wheels, casters, rollers, etc. as described below). In particular, the carriage support assembly 12 has at least one wheel and more preferably has two wheels 50. Preferably, these carriage wheels 50 are attached via respective carriage wheel posts 52 to a carriage support assembly frame 48 which itself is secured to a portion of the driver frame 26 and/or the carriage baseplate 22 (and more preferably, to respective side plates 28 of the drive frame 26 as shown in the figures). To prevent scratching or marring the floor surface 20, the carriage wheels 50 or at least the tires upon the wheels 50 are preferably made of neoprene, but can instead be made from other scratch reducing materials such as rubber or urethane. However, virtually any type of material can be used as desired to make the wheels 50 and/or tires thereon, including without limitation plastic, nylon, and even relatively unusual materials such as wood or composites. The wheels 50 are preferably rotatably attached in a conventional manner to carriage wheel posts 52, which are vertically adjustable to adjust the side-to-side tilt at which the carriage assembly 10 is supported.

Although not required, the carriage wheels 50 are preferably canted with respect to the line of travel of the fastener driving apparatus 1 as shown in the figures. Therefore, when the fastener driving apparatus 1 is pushed in a forward direction (toward the plane of the page in FIGS. 4 and 5), the cant of the carriage wheels 50 pulls the carriage assembly 10 and the fastener driving apparatus 1 to the side or in a lateral direction with respect to the travel path of the fastener driving apparatus 1. This force is desirable where the guide rollers 40 on the baseplate 22 run alongside a new board or flooring piece 42 being laid beside previously-laid flooring 44 as described above. The force urges the guide rollers 40 into contact with the edge of the new board or flooring piece 42 and therefore causes the fastener driving apparatus 1 to travel along and parallel to the new board or flooring piece 42. This permits the driver 18 to drive each fastener at the same location on the edge of the new board or flooring piece 42 or (if desired) at the same horizontal distance from the edge as the fastener driving apparatus 1 is pushed.

The carriage wheels 50 can be replaced by a number of other elements and assemblies capable of supporting the carriage assembly 10 for translational movement across the floor surface 20. For example, the carriage wheels 50 can be replaced by tracks run over a wheel set, a sliding plate or bar (preferably made of low-friction material), one or more casters, and the like. However, the carriage wheels 50 are preferred because they are better adapted to be canted for producing the desired biasing force described above.

The carriage wheel posts 52 can each be constructed from one or more elements which are connected together in any conventional fashion. For example, in the preferred embodiment of the present invention illustrated in the figures, the carriage wheel posts 52 are made of lower posts 54 to which the carriage wheels 50 are rotatably attached and upper posts 56 connected to the carriage support assembly frame 48. The lower post 54 can be connected to the upper post 56 and the upper post 56 can be connected to the carriage support assembly frame 48 in any manner suitable preferably to permit vertical adjustment of the carriage wheels 50. For example, releasable threaded fasteners can be passed through holes (preferably slotted) in one or more of the lower posts 54, upper posts 56, and the carriage support assembly frame 48, one or more of the lower posts 54, upper posts 56, and the carriage support assembly frame 48 can be fitted with a conventional clamp mechanism tightened by threaded fasteners or in another manner well known to those skilled in the art (see the connection between the upper posts 56 and the carriage support assembly frame 48 in the figures), the lower and upper posts 54, 56 can be in telescoping relationship and securable in various positions by a threaded fastener or other conventional fastening device, or one or more of the connections can be made by adjustably threading the lower post 54 into the upper posts 56 or the upper posts 56 into the carriage support assembly frame 48, etc. Where vertical adjustment is not necessary between the lower posts 54, upper posts 56, and the carriage support assembly frame 48, any or all of these elements can be connected via welding, bonding, gluing, riveting, brazing, nailing, etc., and any or all of the elements can even be made integral to one another.

The carriage support assembly frame 48 connects the carriage support assembly 12 to the carriage assembly 10. Like the driver frame 26, any frame design capable of performing this function can be used. In the preferred embodiments of the present invention, the carriage support assembly frame 48 is a pair of plate-shaped arms 58 extending from the carriage wheel posts 52 to the side plates 28 of the driver frame 26. The arms 58 are preferably connected to the side plates 28 by one or more threaded fasteners 122 passing through each arm and plate pair as shown in the figures. However, the connection can also be made by any other conventional element or device, such as by rivets, welding, brazing, clamping, nailing, gluing, bonding, and the like. The carriage support assembly frame 48 can even be made integral to the driver frame 26 if desired. Also, the carriage support assembly frame 48 can be connected to the baseplate 22 rather than or in addition to being connected to the driver frame 26. Such connection can be by any of the manners just described or by those described above with reference to the connection between the side plates 28 of the driver frame 26 and the baseplate 22.

Due to the weight and locations of the actuator 30 and the driver 18 in the preferred embodiments of the present invention, it is desirable to add a counterweight 60 to the fastener driving apparatus 1 opposite the driver 18 and the actuator 30. The counterweight 60 is preferably attached and supported in a conventional manner to the ends of the carriage support assembly frame arms 58 and/or to the carriage wheel posts 52. The counterweight 60 can take a number of different shapes, but is preferably of a weight sufficient to locate the center of gravity of the fastener driving apparatus 1 midway between the casters 36 and the carriage wheels 50 and midway between the casters 36 on the baseplate 22.

As described above, the driver frame 26 functions to support and secure the actuator 30 to the fastener driving apparatus 1 and with respect to the driver 18, and the carriage support assembly frame 48 functions to secure the carriage wheels 50 in place on the fastener driving apparatus 1 and preferably to support the counterweight 60 to the fastener driving apparatus 1. One having ordinary skill in the art will appreciate that these functions can be performed by structures which are significantly different than the structure shown in the drawings. Such other structures include without limitation a tubular frame extending to the actuator 30 and to the positions of the wheels 50 and the counterweight 60 shown in the figures, a T-shaped frame extending up from the baseplate 22 and horizontally outward to the same positions, etc., each such structure falling within the spirit and scope of the present invention.

The handle assembly 14 of the present invention provides convenient access to fastener driving apparatus controls (discussed in more detail below), and permits the fastener driving apparatus 1 to be easily pushed across a floor surface 20. Preferably, the handle assembly 14 has a connection bar 62 extending from a handle bar 64 to a handle assembly mount 66 attached to the baseplate 22. The connection bar 62 can take any form capable of connecting the handle bar 64 to the handle assembly mount 66 and/or to the baseplate 22 (i.e., a shaft, tube, rod, or other elongated member having any desired shape and being either integral with the handle bar 64 or permanently or releasably connected thereto in a conventional manner). The handle bar 64 can take any desired shape or size permitting a user to grasp the handle bar 64 and to manipulate the fastener driving apparatus controls thereon. In the preferred embodiment of the present invention illustrated in the figures, the connection bar 62 is releasably connected to the handle assembly mount 66 by conventional threaded fasteners 68 passing through matching holes in the handle assembly mount 66 and the lower end of the connection bar 62. In alternate embodiments however, conventional threaded fasteners can be used to connect the connection bar 62 directly to the baseplate 22 via matching holes in both elements. Preferably, the fasteners 68 are of a type such as wing nuts or the like which can be loosened and tightened by hand to permit a user to quickly connect and disconnect the handle assembly 14 to and from the handle assembly mount 66. However, the connection bar 62 can be attached to the handle assembly mount 66 and/or directly to the baseplate 22 in many other removable and non-removable ways, including without limitation by welding, brazing, bonding, gluing, press fitting, clamping, a threaded joint, and the like. The connection bar 62 can also be made integral to the baseplate 22 if desired. In most preferred embodiments of the present invention, the handle assembly 14 is removable in order for a user to more easily store and transport the fastener driving apparatus 1. In alternative embodiments of the present invention, the handle assembly 14 can also be mounted on an opposite end of the baseplate 22 (e.g., the front of the baseplate 22) in a similar manner to the connection manner discussed above. To operate the fastener driving apparatus 1 with the handle in this configuration, the carriage wheels 50 are preferably adjusted to be canted in an opposite direction to provide the pulling force discussed above, and the positions of the board follower trigger 106 and the sensor trigger 108 described in more detail below would preferably be adjusted (i.e. removed and replaced on the opposite side of the baseplate 22, moved to another position on the same side of the baseplate 22, etc.) to trigger the driver 18 at the correct time and position. Also, to fully disconnect and remove the handle assembly 14 from the fastener driving apparatus 1, the pneumatic, hydraulic, and/or electrical lines running to and from the safety lever 90 and button trigger 102 as discussed in more detail below can preferably be disconnected. For example, the pneumatic or hydraulic lines can be fitted with conventional quick disconnect couplings and the electrical lines can be fitted with conventional male/female electrical connectors.

In highly preferred embodiments of the present invention, the fastener driving apparatus 1 is provided with at least one tilt wheel 70 rotatably attached to the baseplate 22, the handle assembly 14, the driver frame 26, and/or to the carriage support assembly frame 48. More preferably (and as illustrated in the figures), two tilt wheels 70 are rotatably attached to the connection bar 62 of the handle assembly 14. In particular, the tilt wheels 70 preferably share an axle 72 which is conventionally mounted for rotation in a tilt wheel bracket 74 attached to the connection bar 62 of the handle assembly 14. The tilt wheel bracket 74 is preferably permanently secured to the connection bar 62 by welding, but can instead be attached thereto by any other conventional fastening methods such as by bolting, nailing, bonding, gluing, clamping, riveting, brazing, press-fitting and the like. The tilt wheel or wheels 70 are preferably positioned beside the baseplate 22 to that when the handle assembly 14 is pushed in a downward direction, the fastener driving apparatus 1 pivots about the axle 72 and can thereby be raised off of the floor surface 20. In this manner, the handle assembly 14 can be used as a lever and the tilt wheel or wheels 70 as a fulcrum. This feature is particularly useful when a user desires to turn the fastener driving apparatus 1 around after it has completed a run in one direction to fasten a new board or piece of flooring 42. After the fastener driving apparatus 1 has been tilted, the user can rotate the fastener driving apparatus 1 about the tilt wheel or wheels 70 to a desired position before lowering the fastener driving apparatus 1 to begin another fastener driving run.

It will be appreciated by one having ordinary skill in the art that elements and assemblies other than wheels 70 can be used to perform the same or similar function as the tilt wheels 70. For example, the tilt wheel bracket 74 and the tilt wheels 70 can be replaced by an elongated leg having a pivotable foot at the end thereof capable of operating as a fulcrum for tilting and rotating the fastener driving apparatus 1. As another example, the tilt wheel or wheels 70 can be replaced by casters, rollers, or such other conventional support devices as are described above with respect to the casters 36 on the baseplate 22 and the carriage wheels 50. The fastener driving apparatus 1 can even be tilted and/or pivoted about an edge or protrusion of the baseplate 22 (preferably rounded so as not to mar or scratch the floor surface 20), a roller, a caster, or other such device attached to the baseplate 22. These other elements, assemblies, and manners of tilting and rotating the fastener driving apparatus 1 fall within the spirit and scope of the present invention.

The driver 18 of the driver assembly 16 can be a number of different fastener driving devices well known to those skilled in the art, including without limitation nail guns, staple guns, brad guns, and the like operable electrically, electro-magnetically, hydraulically, pneumatically or otherwise. Most preferably however, the driver 18 has a front portion 76 which is received within a driver bracket 78 attached in a conventional manner to the baseplate 22. Specifically, the driver bracket 78 preferably has a fitting 79 tightenable about the front portion 76 of the driver 18 like a splint clamp or a band clamp, which fitting is attached in a conventional manner (e.g., via welding, brazing, bolting, gluing, and the like) to the baseplate 22 and/or to the side plates 28 of the driver frame 26. Other driver bracket types also perform the same function of securely holding the driver 18 on the carriage assembly 10. For example, the driver bracket 78 can instead be a U, V, or L-shaped plate attached to the driver frame 26 and/or the baseplate 22 and dimensioned to snugly receive the body of the driver 18, a cylinder attached in a similar manner and dimensioned to receive the front portion 76 of the driver 18, etc. Preferably, the driver 18 is positioned and retained in the carriage assembly 10 at an angle (between 0 and 90 degrees) relative to a fully vertical position. More preferably, the driver 18 is positioned at an angle between 10 and 80 degrees. Even more preferably, the driver 18 is positioned at an angle between 30 and 60 degrees). In the most highly preferred embodiments of the present invention such as the embodiment illustrated in the figures, the driver 18 is positioned at approximately a 45 degree angle with respect to the fully vertical position, thereby permitting a fastener to be driven into the side of a new board or piece of flooring 42 and into a frame, structure, or element underlying the new board or piece of flooring 42.

The baseplate 22 preferably has an aperture 80 therein aligned with the trajectory at which fasteners are driven by the driver 18 to permit the fasteners to pass through the baseplate 22. The aperture 80 can be a round hole, a closed slot or a slot open to an edge of the baseplate 22, or any other opening in the baseplate 22 sufficient to permit the fasteners to pass through. Alternatively, the baseplate 22 can be shaped so that it does not extend toward or in the line of the fastener trajectory. Therefore, fasteners driven by the driver 18 preferably pass through the baseplate 22 and into the floor surface 20.

Figure 3:
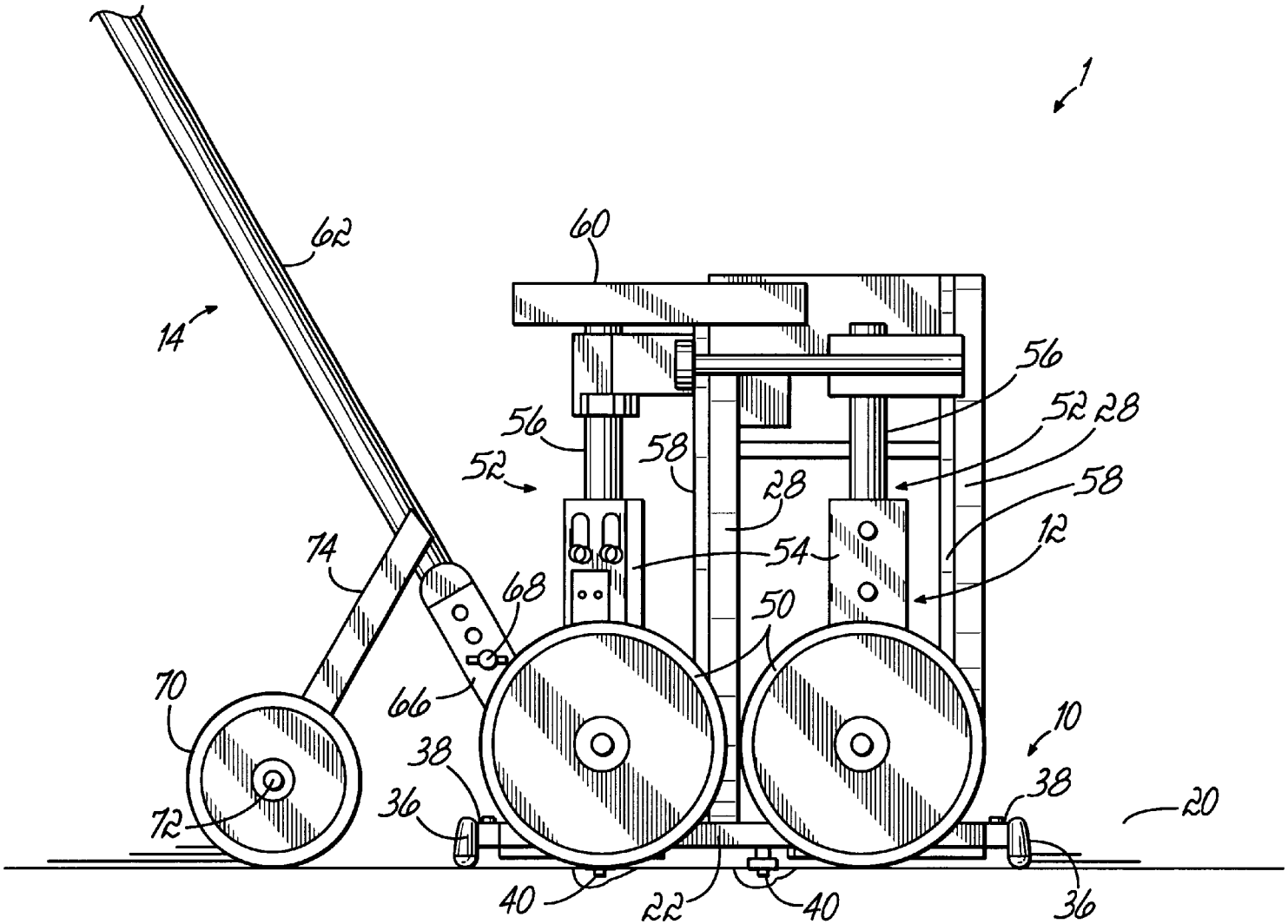
FIG. 3 is a left side elevational view of the fastener driving apparatus illustrated in FIGS. 1 and 2.
Figure 7:
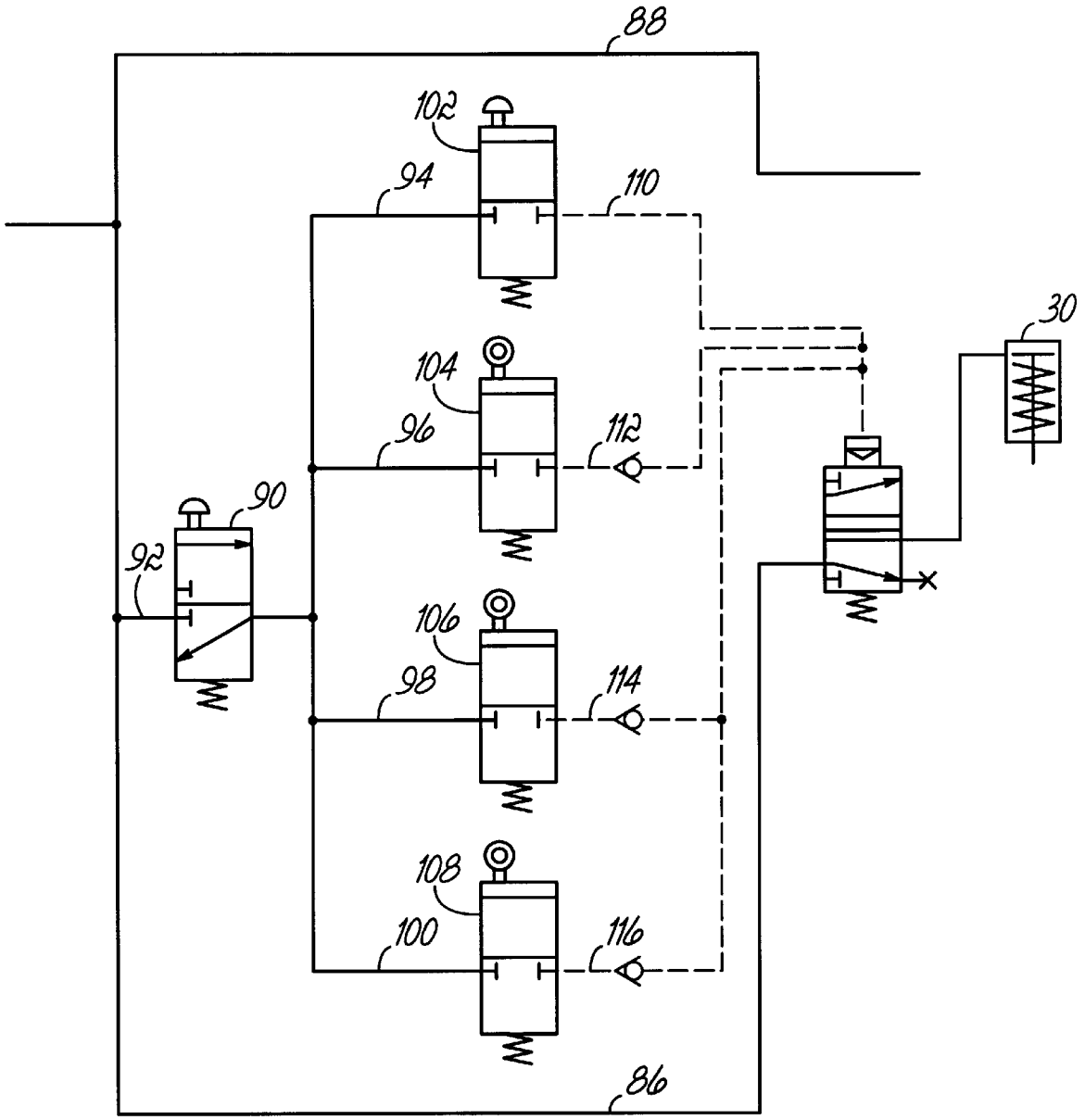
FIG. 7 is a schematic representation of the pneumatic system employed in the preferred embodiment of the present invention illustrated in FIGS. 1–6.

A schematic representation of a preferred embodiment of the driver assembly 16 is shown in FIG. 7. With reference also to FIGS. 1 and 3, air from a pressurized air source (such as an air compressor, a pressurized air tank, and the like) is preferably supplied to the fastener driving apparatus 1 via a valve 82 having a conventional inlet 84. The valve 82 can be secured in many places and in any conventional way to the fastener driving apparatus 1. In the preferred embodiment of the present invention illustrated in the figures, the valve 82 is bolted to a side plate 28 of the driver frame 26. As is best seen in FIG. 7, the valve 82 is preferably a sprig return pilot operated valve which receives air pressure from inlet 84 and which ports the air pressure to the actuator 30 via actuator line 86 when air pressure from one of several devices on the fastener driving apparatus is opened ("triggered") as will now be discussed. When pressurized air is not triggered, the valve 82 returns under spring force to its closed state illustrated in FIG. 7.

Air pressure is also ported to the driver 18 via driver line 88 connected to the valve 82 and to the driver 18 in a conventional manner, and is ported to a manually operated safety lever 90 via a lever line 92 connected to the valve 82 and to the safety lever 90 in a conventional manner. Although not required to practice the present invention, the safety lever 90 helps prevent accidental firing of fasteners by the triggering devices discussed below. The safety lever 90 has a valve which, when operated, opens trigger air line(s) to at least one trigger device. More preferably, when the safety lever 90 is squeezed by a user, air pressure is opened to all lines running to all trigger devices in the fastener driving apparatus 1. Safety levers 90 are well known to those skilled in the art and are therefore not described further herein. For ease of user operation, the safety lever 90 is preferably located in a user-accessible location, and most preferably is located upon the handle bar 64 of the handle assembly 14. It should be noted, however, that the safety lever 90 can be located in a number of other locations upon the fastener driving apparatus 1, including without limitation to the driver frame 26, the carriage support assembly frame 48, and even the baseplate 22 if desired. In the different possible locations of the safety lever 90, a user may operate the safety lever 90 in a variety of different conventional manners, such as by squeezing or raising the lever 90, stepping on the lever 90, rotating or twisting the lever 90, and the like.

In the preferred embodiment of the present invention just described, when air pressure is applied to the valve 82 and the fastener driving apparatus 1 is not operated, the lines 86, 88, 92 to the actuator 30, the driver 18, and the safety lever 90, respectively, are each pressurized. When the safety lever 90 is actuated, one or more lines to the various trigger devices is pressurized. Preferably, the fastener driving apparatus 1 has a button trigger line 94 running to a manually-operated button trigger 102, a cam follower trigger line 96 running to a cam follower trigger 104, a board follower trigger line 98 running to a board follower trigger 106, and a sensor trigger line 100 running to sensor trigger 108. If any of these four trigger devices are triggered when the safety lever 90 is actuated, air pressure is opened to the air return line corresponding to the device triggered. In particular, air return lines 110, 112, 114, 116 run from the button trigger 102, the cam follower trigger 104, the board follower trigger 106, and the sensor trigger 108, respectively, to the valve 82. When any of the trigger devices 102–108 is triggered and pressurizes any of the air return lines 110–116, pressure to the valve 82 causes the valve 82 to move to its second position opening the actuator 30 to air pressure from the supply of pressurized air and causing the actuator 30 to actuate. Actuation of the actuator 30 triggers the driver 18 to drive a fastener. Once the trigger device(s) are no longer triggered, air through the air return lines 110–116 is no longer pressurized and the valve 82 returns under spring pressure to its original closed state shown in FIG. 7. The actuator 30 therefore returns to its original state and the driver 18 is no longer triggered. Preferably, the driver 18 is immediately prepared to be triggered again by the actuator 30 as desired.

Highly preferred embodiments of the present invention can have any one or more of the above-described trigger devices, and preferably are provided with all four. The button trigger 102 is a conventional manually-operated trigger which, like the safety lever 90, is preferably located upon the handle bar 64 of the handle assembly 14 for easy access by a user. However, the button trigger 102 can instead be secured in many other locations upon the fastener driving apparatus 1 if desired (see, for example, the discussion of locations for the safety lever 90 above). The button trigger 102 is preferably used when the user desires to manually trigger the driver 18 during operation of the fastener driving apparatus 1. Button triggers 102 and their manners of connection are well known to those skilled in the art and are therefore not described further herein.

The cam follower trigger 104 is preferably a conventional roller valve secured to a carriage wheel post 52 and positioned to ride upon a cam surface 118 of a carriage wheel 50. The cam surface 118 of the carriage wheel 50 is preferably eccentric with respect to the carriage wheel or has ramp, bump, dip, or other irregularity in its surface to trigger the cam follower trigger 104 as the carriage wheel 50 is turned. Preferably, the cam follower trigger 104 is triggered once every rotation of the carriage wheel 50, thereby opening the connected air return line 112 to the valve 82 and causing actuation of the actuator 30 to trigger the driver 18 once every rotation of the carriage wheel 50. A fastener is therefore preferably driven every rotation of the carriage wheel 50 as the fastener driving apparatus 1 is pushed (e.g., along a new board or piece of flooring 42). Like button triggers, roller valves are well known to those skilled in the art and are also therefore not described further herein.

The spacing between fasteners can be adjusted by changing the radius of the carriage wheel 50 or by altering the number of ramps, bumps, dips, or other irregularities in the cam surface 118. To this end, the fastener driving apparatus 1 can be provided with two or more different wheel sets having different cam surfaces 118 or wheel radii so that the distance between driven fasteners can be changed. Alternately, a number of different cam surfaces 118 can be provided, each one of which has a different cam profile and which is removable from the wheel 50 in a conventional manner (e.g., screwed on the wheel axle, axially bolted or otherwise secured to the side of the wheel 50, and the like).

A third type of trigger device is particularly useful in the type of flooring application shown in the drawings, where boards or pieces of flooring are being fastened to an underlying frame such as a set of sleepers beneath a gym floor. Accurately positioning the fastener driving apparatus 1 to manually trigger the driver 18 for driving a fastener into a sleeper can be very difficult, and selecting a cam profile on a carriage wheel 50 to cause driver triggering at the same distance intervals as sleeper spacing can also be difficult, especially where the distances between sleepers are not exact or where the sleepers are not regularly spaced. In such a case, the board follower trigger 106 can be used to physically detect the passage of a sleeper beneath and beside the new board or piece of flooring 42 being laid. The board follower trigger 106 is preferably a conventional lever valve. Lever valves are well known to those skilled in the art and are therefore not described further herein.

The board follower trigger 106 is preferably mounted to the baseplate 22 as described below. However, the board follower trigger 106 can instead be mounted in almost any location on the fastener driving apparatus 1 (such as to the driver frame 26 and/or the carriage support assembly frame 48 depending upon the arrangement of such assemblies and the length of the board follower trigger 106), but should at least extend to a position below the new board or piece of flooring 42 being laid in order to contact sleepers passed by movement of the fastener driving apparatus 1.

Figure 6:
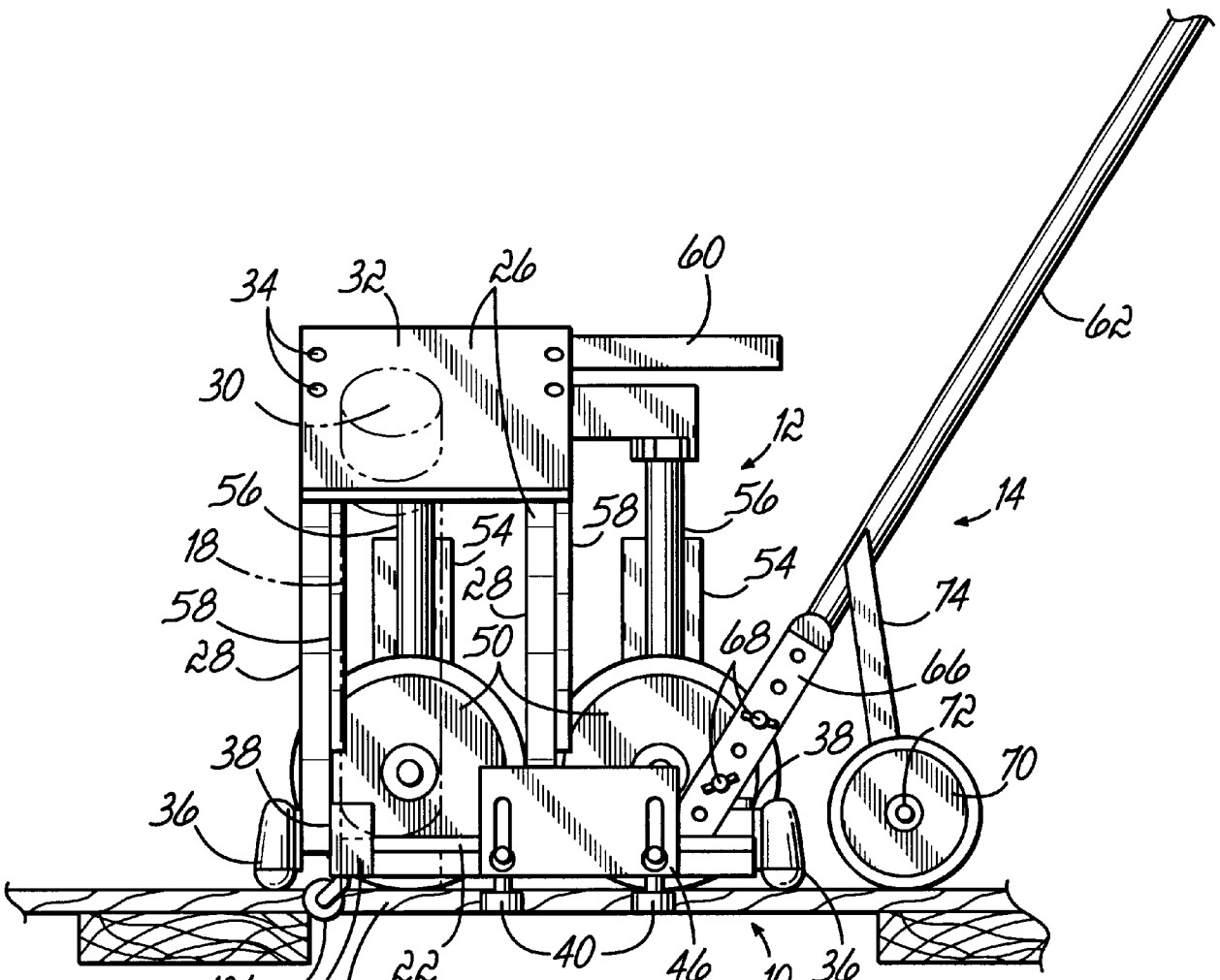
FIG. 6 is a right side elevational view of the fastener driving apparatus illustrated in FIGS. 1–5, showing the board follower trigger being used.

The board follower trigger 106 can be pivotably attached directly to the baseplate 22 in any conventional manner, but more preferably is pivotably attached to a mount 120 which itself is adjustably attached to the baseplate 22 as shown in FIG. 6. Specifically, the mount 120 is preferably attached to the baseplate 22 via one or more threaded fasteners passing through slotted holes in the mount 120 and which can be loosened to adjust the vertical position of the mount 120 and the board follower trigger 106 thereon. One having ordinary skill in the art will appreciate that a number of other releasably devices and elements can instead be used to adjustably mount the board follower trigger 106 to the baseplate 22. For example, the mount 120 can be moved and releasably secured in a range of positions (via one or more conventional fasteners) between rails on the side of the baseplate 22, the board follower trigger 106 can be attached to a vertical rod which is threadable into and out of a vertical hole in the baseplate 22, the board follower trigger 106 can be attached to a member which itself is releasably pivotable via one or more conventional fasteners on the side of the baseplate 22 to pivot the board follower trigger 106 toward or away from the sleepers, etc. Such alternative devices and elements fall within the spirit and scope of the present invention. Where vertical adjustability is not desired, the board follower trigger 106 is preferably secured directly to the baseplate 22.

When the board follower trigger 106 is lowered sufficiently to the level of the sleepers or other framework to which the floor surface 20 is being fastened, movement of the fastener driving apparatus 1 across the floor surface 20 causes the board follower trigger 106 to ride against, up, and past the passing sleepers. Each time a sleeper causes such motion of the board follower trigger 106, the valve in the board follower trigger opens to pressurize the air return line 114 to the valve 82, thereby actuating the actuator 30 and triggering the driver 18 to drive a fastener into the new board or piece of flooring 42 and the underlying sleeper. For proper timing and alignment of the driven fastener and the board following trigger 106, the board following trigger 106 is preferably located upon the baseplate 22 so that it is aligned with the fastener line of trajectory. Therefore, when the board following trigger 106 is triggered by a sleeper, the fastener line of trajectory will also be properly aligned with the sleeper.

A fourth type of trigger device, the sensor trigger 108, is particularly useful in those applications where the sleepers are not exposed as they are in the above application where the board following trigger 106 is used. For example, in certain applications the sleepers are first covered by a layer of material (plywood, particle board, etc.) before the boards or pieces of flooring 42 are laid. In such an application, time-consuming steps must be taken to mark where underlying sleepers lie beneath the layer of material. However, the present invention is preferably provided with a conventional sensor trigger 108 which detects the density of material underlying the layer of material.

When the fastener driving apparatus 1 passes a sleeper, the sensor trigger 108 detects the sleeper and opens the air return line 116 to the valve 82 in a conventional manner, thereby pressurizing the air return line 116, causing the actuator 30 to actuate, triggering the driver 18, and driving a fastener into the floor. Density triggers capable of detecting studs, supports, sleepers, and other such elements behind a layer of material are well known to those skilled in the art and are therefore not described further herein. Additionally, the manner in which such triggers are operably connected to control valves is also well known to those skilled in the art and is not therefore described further herein.

The sensor trigger 108 can be located in many different locations on the fastener driving apparatus 1. The placement of the sensor trigger 108 is limited, however, by the ability of the particular sensor trigger 108 used to detect sleepers or other framework elements from its location on the fastener driving apparatus 1. In much the same manner as the board follower trigger 106 described above, the sensor trigger 108 should be located on the fastener driving apparatus 1 so that when a sleeper is detected and the fastener is fired, the fastener fires into the new board or piece of material 42 and the sleeper. In most preferred embodiments of the present invention, the sensor trigger 108 is located upon the baseplate 22 so that it is aligned with the fastener line of trajectory. Therefore, when the sensor trigger 108 detects a sleeper and triggers the actuator 30 and the driver 18, the fastener line of trajectory will also be properly aligned with the sleeper. The sensor trigger 108 can be located to detect a sleeper beneath the new board or piece of flooring being fastened and/or the previously laid flooring 44 as desired.

In the preferred embodiments of the present invention, four different types of trigger devices are employed (a manual trigger 102, a cam-operated trigger 104 on a carriage wheel 50 for firing fasteners at set intervals, a board follower trigger 106 physically triggered by passing sleepers, and a sensor trigger 108 triggered by detecting the density of passing sleepers. Any one or more of these trigger devices can be employed on the fastener driving apparatus 1 of the present invention. Some apparatus designs can even include more than one of the same trigger device. For example, where two carriage wheels 50 are employed on a fastener driving apparatus 1, each wheel can carry a different cam surface 118 to operate a respective cam follower trigger 104 at different intervals. By selectively enabling the operation of one or the other cam follower trigger 104 (e.g., via dedicated safety levers to each of the cam follower triggers 104), different fastener driving intervals can be selected by a user without changing carriage wheels 104 or cam surfaces 118.

In alternate embodiments of the present invention, the various trigger devices employed can be selectively enabled by additional safety levers 90. Specifically, it is possible to connect one or more safety levers to one or more of the trigger devices, and even to have a dedicated safety lever 90 for each specific trigger device. Therefore the apparatus can be configured such that by operating a safety lever 90 one, two, or more of the trigger devices are enabled while the others remain disabled and are operable by one or more other safety levers 90.

The various trigger devices of the present invention each have a valve associated therewith (i.e., a valve operable by a push button, a follower riding upon a cam surface, a lever movable between at least two positions, and a sensor). Along with the pivot operated spring return valve 82, each of these valves are conventional in nature and are well known to those skilled in the art. It should be noted that each such valve can be replaced by one or more valves of another type which perform the same or similar functions and which operate in the same or similar ways. As such, it will be appreciated by one having ordinary skill in the art that the present invention is not limited by or to the particular valve types discussed above for the trigger devices and the pilot operated valve 82.

Similarly, the present invention is not to be limited to the particular arrangement and connection of trigger devices and lines illustrated in the figures. Although the illustrated arrangement and connection is preferred, significantly different arrangements and connections would be recognized by one having ordinary skill in the art. For example, air lines to the various trigger devices in the fastener driving apparatus 1 need not run from a safety lever 90. Also, one or more of the trigger devices can have a dedicated air line running thereto from a multiple port valve maintaining pressure to operate the associated trigger devices. Rather than run to a valve 82 as in the preferred embodiments of the present invention, one or more of the return lines 110–116 can instead run directly to associated port(s) on the actuator 30, in which case the air pressure opened by triggering such trigger devices is sufficient to actuate the actuator 30 rather than just to send a pilot signal (as in the preferred embodiments of the present invention). In yet another embodiment, the trigger of the driver 18 is hydraulically actuated by an air pressure pilot signal. In this case, one or more of the return lines 110–116 can run directly to associated port(s) on the trigger of the driver 18.

The carriage assembly 10, driver frame 26, and carriage support assembly frame 48 are preferably made from a material capable of supporting the other various components of the fastener driving apparatus 1. For example, these parts of the fastener driving apparatus 1 can be made of steel, iron, aluminum or other metals, wood, composites, fiberglass, plastic and the like. More preferably, the carriage assembly 10, driver frame 26, carriage support assembly frame 48, and the handle assembly 14 are made of aluminum. The handle assembly 14 and the carriage wheel posts 52 and cam surfaces 118 of the carriage support assembly 12 can also be made of the above-listed materials, but are preferably made of aluminum or steel. The carriage wheels 50 (or at least tires upon the wheels) can also be made of the above-listed materials, but preferably are made of a material which can grip the floor surface 20 to some degree while not marring or scratching the floor surface 20. As described earlier, such materials include without limitation rubber, urethane, neoprene, nylon, soft plastics, composites, and the like. Most preferably however, the carriage wheels 50 have tires made of neoprene.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the preferred embodiments of the present invention described above and illustrated in the drawings employs a pneumatic system for controlling and porting air to the various components and trigger devices of the fastener driving apparatus 1. However, other well known systems can be used to perform the same or substantially similar functions as the pneumatic system. For example, the pneumatic system disclosed can operate with air, gas, or any mixture thereof as desired. Also, the pneumatic system can be replaced by a hydraulic system of comparable design and construction and operating with virtually any type of fluid, but more preferably operating with water or hydraulic oil.

One having ordinary skill in the art will also recognize that the functions performed by the pneumatic system employed in the present invention can be performed by electrical or electromechanical systems. For example, the valve 82 can be operated by electrical signals rather than by air pressure pilot signals. Valves which are electrically operated are well known to those skilled in the art and are not therefore described further herein. In this type of arrangement, one or more of the trigger devices can be operable to emit a signal which is received by the valve 82 to control the state or position of the valve 82. Such signal types include without limitation electrical signals sent via electrical lines to the electrically operated valve 82 or directly to the actuator 30 or driver trigger itself, transmissions sent via radio, infrared, microwave, optical or other signals in the electromagnetic spectrum, and the like. Trigger devices which emit electrical signals upon triggering are well known to those skilled in the art. Also, transmitters (on the trigger devices) and receivers (on the valve 82, actuator 30, or driver 18) are also well known to those skilled in the art. The use of these alternate control systems and elements is dependent at least partly upon whether the driver 18 and/or the actuator 30 selected for the apparatus 1 is electrically, pneumatically, hydraulically or manually triggered, whether an actuator 30 is used in the apparatus 1, and the intended applications in which the apparatus 1 will be used.

For example, any one or more of the trigger devices can be or include an optical sensor for detecting the presence or motion of elements or structure in the operation of the fastener driving apparatus 1. The cam follower trigger 104 can be an optical sensor detecting the shape, color, or motion of the cam surface 118 as the fastener driving apparatus 1 is rolled, sending or transmitting a signal (to the valve 82, actuator 30, or driver 18 for firing a fastener) in a conventional manner preferably at regular intervals corresponding to one or more locations on the cam surface 118. The board follower trigger 106 can instead be an optical sensor for detecting the passage of a sleeper or other element and sending or transmitting a signal in the same manner. The sensor trigger 108 can also be an optical sensor detecting a mark or marks located or pre-placed upon a layer of material indicating the location of underlying sleepers, framework, or other substructure. In a highly preferred embodiment of the present invention, the sensor trigger 108 is a metal detection sensor or a magnetic sensor capable of detecting fasteners already driven into previously-laid flooring 20 (adjacent to the board or piece of flooring 42 being laid) or flooring substructure (such as plywood or other flooring material laid over sleepers). Therefore, as the carriage assembly 102 is pushed across the previously-laid flooring 44, the sensor 108 is preferably located to sense the passing of fasteners which have already been driven in order to provide a trigger point for driving later fasteners.

Any one or more of the safety lever 90, button trigger 102, cam follower trigger 104, and the board follower trigger 106 described above can be a hydraulic or pneumatic valve triggered either by physical contact or pressure, by optical detection via a conventional optical sensor, or by other sensor types well known to those skilled in the art. The sensor trigger 108 can be triggered by density, ultrasound, and in other ways well known to those skilled in the art and not requiring physical contact with or exposure of the elements or framework being detected. Any one or more of the safety lever 90, button trigger 102, cam follower trigger 104, board follower trigger 106, and sensor trigger 108 can send a signal to receiver(s) on the valve 82, the actuator 30 or the driver 18 in a conventional manner to drive a fastener also in a conventional manner. The signals transmitted can be in the form of pneumatic, hydraulic, electrical signals (whether via wired or wireless transmission), and any other signal type capable of being transmitted from the above devices 90, 102–108 to the receiver(s).

It should be noted that if desired, operations of the elements, components, and trigger devices of the present invention can be controlled wholly or in part by solid state controls, a microprocessor, discreet electrical components, and the like. Signals sent to and from one or more of the trigger devices, the valve 82, the actuator 30, and the driver 18 can be controlled by such electronics in a manner well known to those skilled in the art.

A significant amount of structure in the fastener driving apparatus 1 is dependent upon the shape, size, and configuration of the driver 18 and the actuator 30. For example, the actuator 30 in the preferred embodiments of the present invention disclosed herein is mounted to and positioned by a driver frame 26. In alternative embodiments of the present invention, the actuator 30 can be mounted or coupled directly to the driver 18, or the driver 18 can be directly actuated via pneumatic, hydraulic, electrical, or other lines, or can be actuated by a transmitter-receiver system as discussed above. Therefore, the particular shape and position of the driver frame 26 can be quite different than that shown in the figures, particularly where the driver 18 is not directly connected to the driver frame 26 or dependent thereon for support (as is the case where the driver bracket 78 is used to fully hold and support the driver 18 in position upon the carriage assembly 10). In such an arrangement, the carriage support assembly frame 48 can be connected to the baseplate 22 as described above to permit the driver frame 26 to be removed entirely from the design of the assembly 1.

Figure 4:
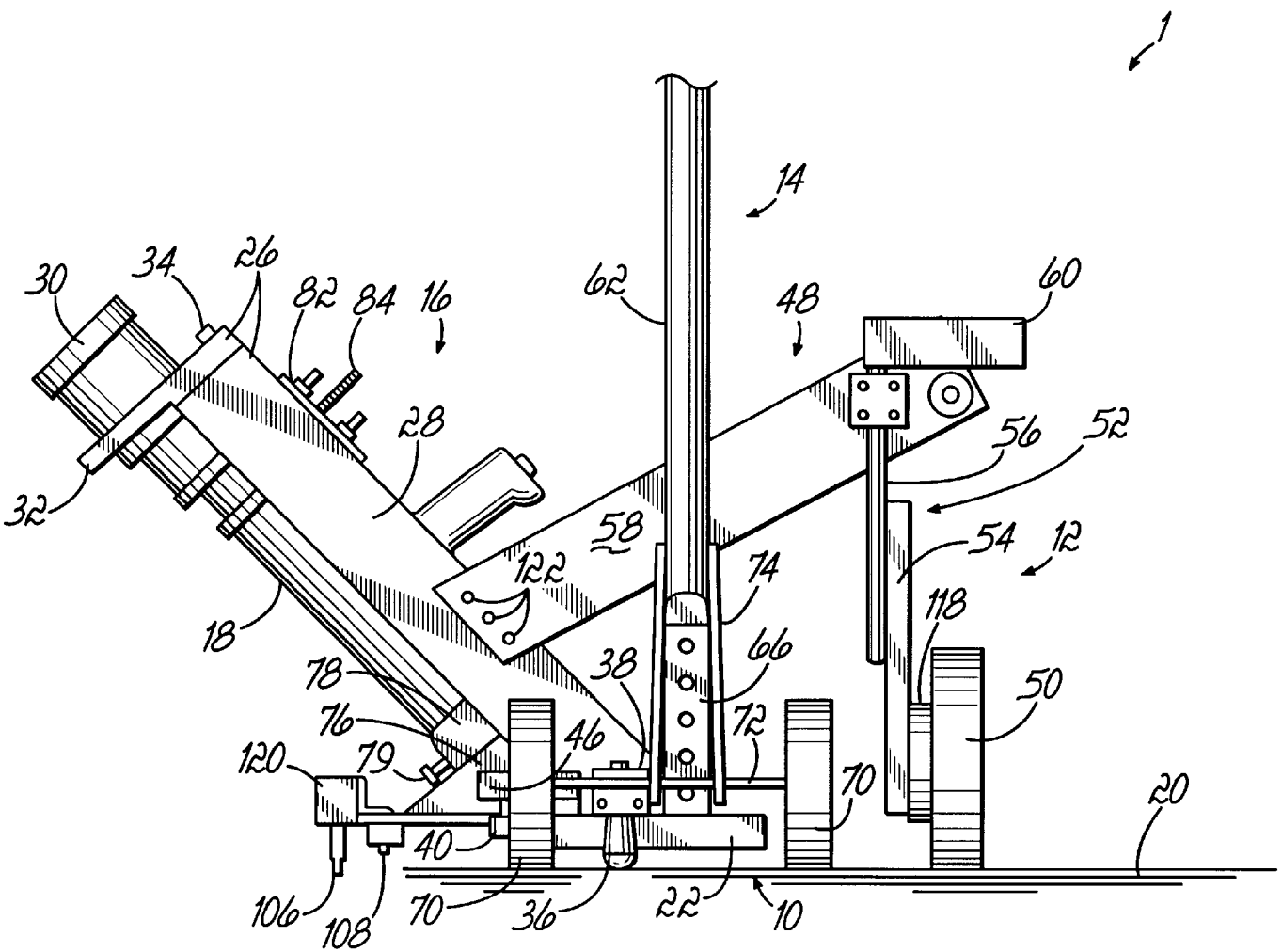
FIG. 4 is an elevational rear view of the fastener driving apparatus illustrated in FIGS. 1–3.

In other preferred embodiments of the present invention, the driver's position with respect to the floor surface 20 is adjustable. Angular adjustment can be performed in many conventional manners well known to those skilled in the art. For example, the driver bracket 78 can be rotatably attached to the baseplate 22 via a pivot rod (not shown) rather than being rigidly attached thereto. The pivot rod preferably passes between the side plates 28 of the driver frame 26 or between lugs (also not shown) extending above the surface of the baseplate 22. Also preferably, the pivot rod can be releasably secured against rotation in a conventional manner such as by one or more threaded fasteners on the pivot rod and abutting against the side plates 28 or the lugs, by setscrews passed through collars and against the pivot rod, etc. The driver bracket 78 can also have a set of teeth or a pawl rigidly attached to the pivot rod and interacting with a pawl or set of teeth, respectively, attached to the baseplate 22 or to the side plates 28, thereby providing discrete positions at preferred angular increments for the driver 18. In other embodiments, the driver 18 and/or the driver bracket 78 is attached to one or both side plates 28, which themselves are adjustable with respect to the baseplate 22. Specifically, the side plates 28 can be rotatably mounted in a conventional manner to the baseplate 22, and can be fixed in a range of positions by fasteners passing through the side plates from arms 58 (for example). In FIGS. 4 and 5, if the arms 58 of the carriage support assembly frame 48 were extended further past the side plates 28 of the driver frame 26 and were provided with elongated holes or a series of slotted holes through which releasable fasteners 122 pass, the side plates 28 could be pivoted and secured in a number of desired angular positions with respect to the baseplate 22. If adjustability is provided for the fastener driving apparatus 1, most preferably such adjustment is possible through a fully vertical position down to a horizontal position with respect to the floor surface 20, in which case the position of the actuator 30 and top plate 32 shown in the figures would need to be moved to permit this adjustment range. One having ordinary skill in the art will recognize that other manners of angular adjustment are also possible to achieve the same results as just described.

I claim:

1. A fastening apparatus for driving fasteners into a row of unsecured floor members located alongside and in abutting relationship with at least one row of previously laid and secured floor members, the rows of floor members defining a floor surface residing over a substructure, the fastening apparatus comprising:

a carriage;

at least one carriage motion element supporting the carriage a desired distance above the floor surface;

a handle mounted to a first end of the carriage to facilitate moving the carriage along the floor surface above said row of unsecured members;

a fastener driver secured to the carriage and operable to drive fasteners into said row of unsecured members as the carriage moves therealong;

at least one carriage guide element coupled to the carriage to ride against and alongside said row of unsecured floor members as the carriage moves therealong; and biasing means coupled to the carriage at a second end thereof, located opposite the first end, to urge the carriage toward the at least one row of previously-laid and secured floor members as the carriage is moved along the floor surface above said row of unsecured members by pushing the handle, the biasing means cooperating with the at least one carriage guide element to keep the fastener in proper alignment with said row of unsecured members, thereby to assure proper securement of said row to the substructure.

2. The fastening device as claimed in claim 1, wherein the at least one carriage motion element is a wheel coupled to the carriage.

3. The fastening device as claimed in claim 1, wherein the biasing means comprises at least one wheel.

4. The fastening device as claimed in claim 1, wherein the carriage guide element is a roller coupled to the carriage and is adapted to ride against and alongside the member.

5. The fastening device as claimed in claim 1, wherein the carriage guide element is a part of the carriage and is adapted to ride against and alongside said row of unsecured members.

6. The fastening device as claimed in claim 1, wherein the fastener driver is positioned upon the carriage to drive fasteners at an incline with respect to said row of unsecured members.

7. The fastening device as claimed in claim 6, wherein the incline is between 10 and 80 degrees.

8. The fastening device as claimed in claim 7, wherein the incline is between 30 and 60 degrees.

9. The fastening device as claimed in claim 6, wherein the fastener driver is positionable in a range of angles with respect to said row of unsecured members for adjusting the incline.

10. The fastening device as claimed in claim 1, further comprising a trigger mechanism coupled to the fastener driver, the fastener driver responsive to triggering of the trigger mechanism to drive a fastener into said row of unsecured members.

11. The fastening device as claimed in claim 10, wherein the trigger mechanism is a density sensor for detecting underlying at least one of the floor surface and said row of unsecured members, the trigger mechanism being responsive to detection of a predetermined density level to actuate the fastener driver.

12. The fastening device as claimed in claim 10, wherein the trigger mechanism is a trip lever triggered by passage over sleepers upon which the member is laid.

13. The fastening device as claimed in claim 10, wherein the trigger mechanism is tripped by rotation of a cam located on the carriage motion element, the fastener driver thereby actuated to drive a fastener in synchronization with cam rotation.

14. The fastening device as claimed in claim 13, wherein the carriage motion element is a wheel coupled to the carriage.

15. The fastening device as claimed in claim 10, wherein the trigger mechanism is a trigger manually operable by a user.

16. The fastening device as claimed in claim 10, wherein the trigger mechanism is pneumatic and wherein the fastener driver is pneumatically actuatable, the trigger mechanism being in fluid communication with the fastener driver.

17. The fastening device as claimed in claim 10, wherein the trigger mechanism is configured and arranged to emit an electrical signal when triggered and wherein the fastener driver is electrically actuatable and is responsive to the signal by driving a fastener into the member.

18. The fastening device as claimed in claim 1, wherein the carriage motion element supports at least part of the carriage a distance above the previously-laid surface, the distance being adjustable by a user.

19. The fastening device as claimed in claim 1, wherein the at least one guide element is positioned a distance below the carriage.

20. The fastening device as claimed in claim 1, wherein the at least one guide element is positioned a distance below the carriage, the distance being adjustable by a user.

21. The fastening device as claimed in claim 1, further comprising at least one secondary carriage motion element coupled to the carriage and supporting the fastening device for motion over the previously-laid surface and said row of unsecured members.

* * * * *